US006295362B1

(12) United States Patent
Zhang

(10) Patent No.: US 6,295,362 B1
(45) Date of Patent: Sep. 25, 2001

(54) DIRECT DIGITAL SYNTHESIS OF FM SIGNALS

(75) Inventor: Qin Zhang, Bensalem, PA (US)

(73) Assignee: General Instrument Corporation, Horsham, PA (US)

( * ) Notice: Subject to any disclaimer, the term of this patent is extended or adjusted under 35 U.S.C. 154(b) by 0 days.

(21) Appl. No.: 09/009,695

(22) Filed: Jan. 20, 1998

(51) Int. Cl.[7] ..... H04H 5/00

(52) U.S. Cl. ..... 381/2; 381/3; 381/6; 381/10; 375/376; 375/295

(58) Field of Search ..... 381/3, 1, 2, 4, 381/5, 6, 7, 10, 13, 14, 16; 37/395–6, 299, 301, 303, 332; 332/117; 455/295, 63, 110, 118; 375/295–6, 299, 301, 303, 332, 376, 377

(56) References Cited

U.S. PATENT DOCUMENTS 4,893,341 * 1/1990 Gehring ..... 381/7
5,119,503 * 6/1992 Mankovitz ..... 381/14
5,129,036 * 7/1992 Dean et al. ..... 381/2
5,283,780 * 2/1994 Schuchman et al. ..... 381/2
5,315,583 * 5/1994 Murphy et al. ..... 381/4
5,327,132 * 7/1994 Whitecar et al. ..... 381/2
5,682,431 * 10/1997 Ohnishi et al. ..... 381/14
5,822,383 * 10/1998 Muntz et al. ..... 375/362
5,909,148 * 6/1999 Tanaka ..... 375/376

* cited by examiner

*Primary Examiner*—Xu Mei
(74) *Attorney, Agent, or Firm*—Rader, Fishman & Grauer

(57) ABSTRACT

A digital FM signal generator allows the generation of a modulated FM signal for broadcasting without the need for an analog modulator. The signal generator includes a digital signal processor which receives left and right signals from left and right signal channels and interpolates the signals to create a composite base band signal. The composite base band signal is then used by a numerically controlled oscillator to modulate a digital carrier signal. The result is a digital modulated FM RF signal which is then converted to an analog signal for broadcasting.

5 Claims, 6 Drawing Sheets

DIRECT DIGITAL SYNTHESIS OF FM SIGNALS

FIELD OF THE INVENTION

The present invention relates to the generation of composite stereo signals for broadcasting in the FM frequency band. More particularly, the present invention relates to a novel circuit for direct digital synthesis of composite stereo signals for broadcast in the FM frequency band.

BACKGROUND OF THE INVENTION

In FM broadcasting, left and right stereo base band signals are low-pass filtered and combined to produce a composite stereo signal. The circuit that combines the left and right component signals and produces the composite stereo signal is called an exciter.

Once generated, the composite signal is used to drive an FM modulator which modulates a carrier wave in accordance with the composite signal. The modulated carrier wave is then broadcast using an FM antenna.

To be broadcast from an antenna, the modulated carrier wave must be an analog signal. For this reason, conventional systems have generated the composite stereo signal using analog equipment. However, there are a number of difficulties that arise in generating the composite stereo signal in the analog format. For example, low-pass filtering and sub-carrier stereo modulation are very complicated for an analog system. Mechanical filters may be used, but are large and bulky. Additionally, analog filters introduce phase distortions and group delay distortions into the resulting signal. These distortions are very difficult to correct.

The alternative is to generate the stereo composite signal in the digital format and then, eventually, convert the signal to an analog signal for broadcasting. With recent advances in the quality of digital signal processing hardware, including high speed, high precision A/D and D/A converters, an FM exciter using digital signal processing has a far superior performance than the counterpart analog system and costs much less.

FIG. 1 shows a typical digital signal processing system for a digital FM exciter. In FIG. 1, the left channel 101 provides a left analog audio signal which becomes the left component of the composite stereo signal. Similarly, the right channel 102 provides a right analog audio signal which becomes the right component of the composite stereo signal.

The left and right analog signals are respectively processed by anti-aliasing filters 104 and 105. After filtering, the left and right signals are respectively converted from analog into digital signals by A/D converters 107 and 108. The converted digital signals are provided to a digital signal processor (DSP) 109.

Generally speaking, the DSP 109 combines the left and right signals into a composite digital signal. More specifically, the DSP 109 performs band limiting filtering, pre-emphasizing, left and right channel mixing, sub-carrier generation, sub-carrier modulation and Sin(x)/x compensation for the D/A converter. Additionally, the DSP 109 provides soft level limiting (soft clipping), loudness signal monitoring for analog and digital automatic gain control, and spectrum analysis for optimized system control and operation.

The composite digital signal output by the DSP 109 is then converted to an analog signal by D/A converter 111 and filtered through low pass filter 150. The result is a composite analog base-band stereo signal 151 which may be used to modulate a carrier wave which is then broadcast by an FM antenna.

The drawbacks of this system result from the fact that the D/A converter 111 and the external analog FM modulator (not shown) must be of the highest quality, and therefore are very expensive. The high quality processing achieved by the front end A/D converters 107 and 108 and the DSP 109 will be lost if the D/A converter 111 and analog FM modulator (not shown) cannot match the performance of the DSP 109.

Accordingly, there is a need in the art for a system that digitally generates a high quality analog stereo signal without making excessive demands on the D/A converter and analog FM modulator which must receive and prepare the stereo signal for broadcasting.

SUMMARY OF THE INVENTION

It is an object of the present invention to meet the above-described needs and others. Specifically, it is an object of the present invention to provide a signal generator which digitally modulates a carrier signal to produce a digital modulated signal which can be converted to an analog signal for broadcasting without the need for an analog modulator.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, the present invention may be embodied as a digital modulated signal generator having a digital signal processor for receiving and processing left and right signals from left and right signal channels to produce a composite base band signal; and a numerically controlled oscillator for receiving the composite base band signal and generating a modulated digitial carrier signal which is modulated in accordance with the composite base band signal. Preferably, the frequency of the numerically controlled oscillator is updated at a fraction of a clock signal of the numerically controlled oscillator.

The present invention may further include a digital-to-analog converter for converting the modulated digital carrier signal into a modulated analog signal. A band pass filter may be used for filtering the modulated analog signal to remove harmonic distortions created by the numerically controlled oscillator.

Preferrably, the digital signal processor includes six digital signal processing units, each of which has a different sampling rate. The first of these digital signal processing units receives and samples the left and right signals. The first digital processing unit then interpolates the signals with a base band filter to eliminate cross talk between the left and right signals; a pre-emphasis filter; a sampling speed-up converter; and an anti-aliasing filter.

The third of the digital signal processing units computes addition (L+R) and difference (L−R) signals from the left and right signals. The fourth of the digital signal processing units which may receive SCA data and modulate a sub-carrier with the SCA data.

If SCA data is used, the present invention may include an SCA error control circuit which governs the modulation of the sub-carrier, the SCA error control circuit including: a Reed-Solomon encoder; an inter-leaver connected to the Reed-Solomon encoder; a convolution and differential encoder connected to the inter-leaver; a base band shaping unit connected to the convolution and differential encoder; an RF unit connected to the base band shaping unit; a convolution and differential decoder connected to the RF unit; a de-inter-leaver connected to the convolution and differential decoder; and a Reed-Solomon decoder connected to the de-inter-leaver.

The present invention may also include a gain control unit and an analog-to-digital converter in each of the left and right signal channels. The gain control units provide a gain control signal to the respective analog-to-digital converters and to the digital signal processor.

The present invention also encompasses a method of generating a digital modulated signal by digitally modulating a digital carrier signal with a numerically controlled oscillator in accordance with a composite base band signal produced by a digital signal processor from left and right signals received from left and right signal channels. Preferrably, the method includes updating a frequency of the numerically controlled oscillator at a frequency lower than a frequency of a clock signal of the numerically controlled oscillator.

The method of the present invention may also include converting the modulated digital carrier signal into a modulated analog signal for broadcasting. A further step of filtering the modulated analog signal to remove harmonic distortions created by the numerically controlled oscillator with a band pass filter may also be included.

If the digital signal processor comprises six digital signal processing units, the method includes sampling with each of the digital signal processing units at a different sampling rate.

The present method may also include interpolating the left and right signals a plurality of times with the digital signal processor; and modulating a sub-carrier with SCA data with the digital signal processor which receives an input signal containing the SCA data. Where a sub-carrier is modulated with SCA data, the method may include controlling an SCA error with an SCA error control circuit.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Using the drawings, the preferred embodiments of the present invention will now be explained. The present invention provides an all digital FM radio frequency signal synthesizer which produces a composite stereo signal without requiring an analog carrier wave modulator.

Figure 1:
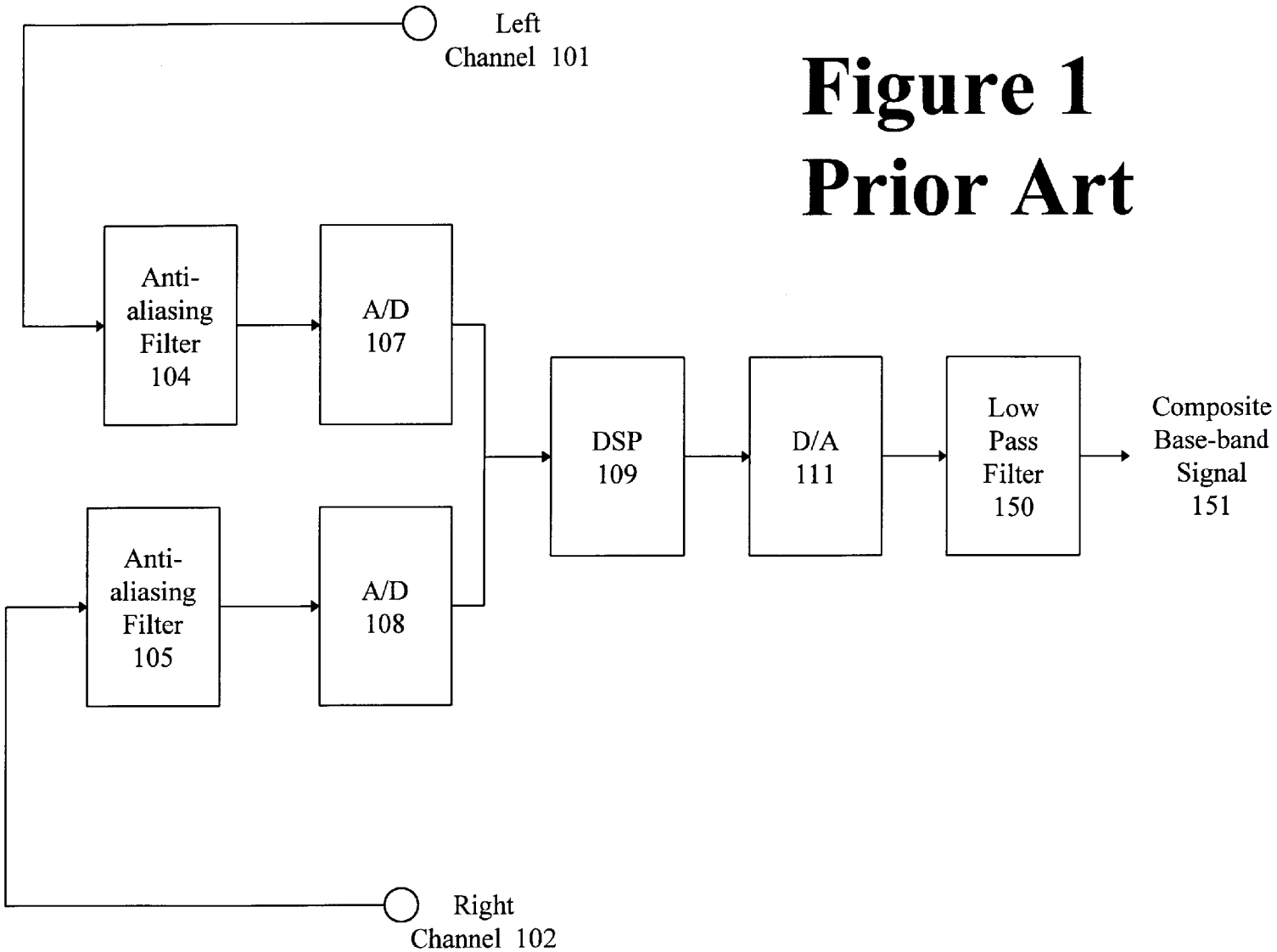
Figure 1 Prior Art
FIG. 1 illustrates a conventional system for digitally processing a composite stereo signal prior to modulation.
Figure 2:
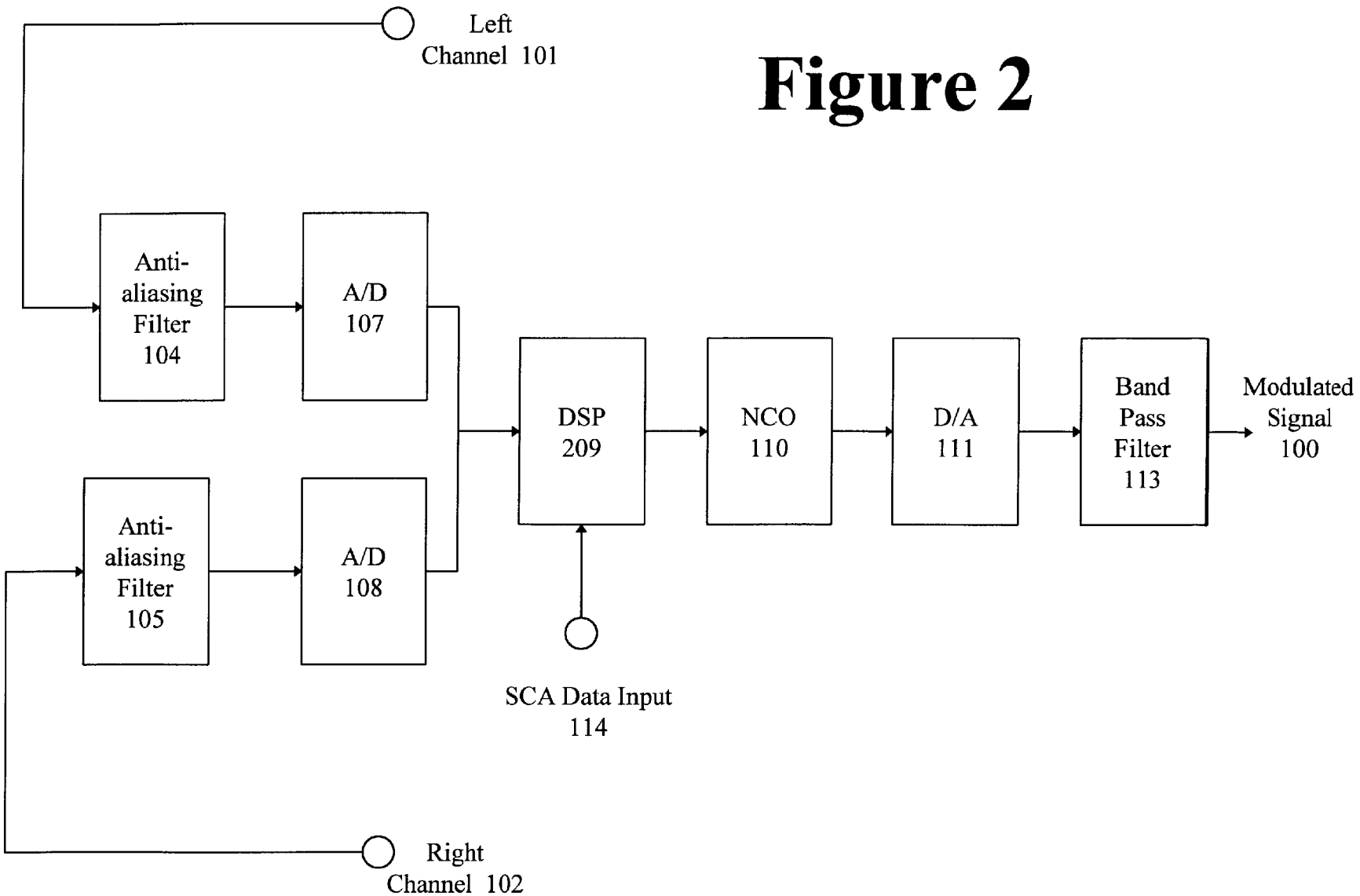
FIG. 2 illustrates a system for producing a digital modulated signal according to the present invention.
Figure 3:
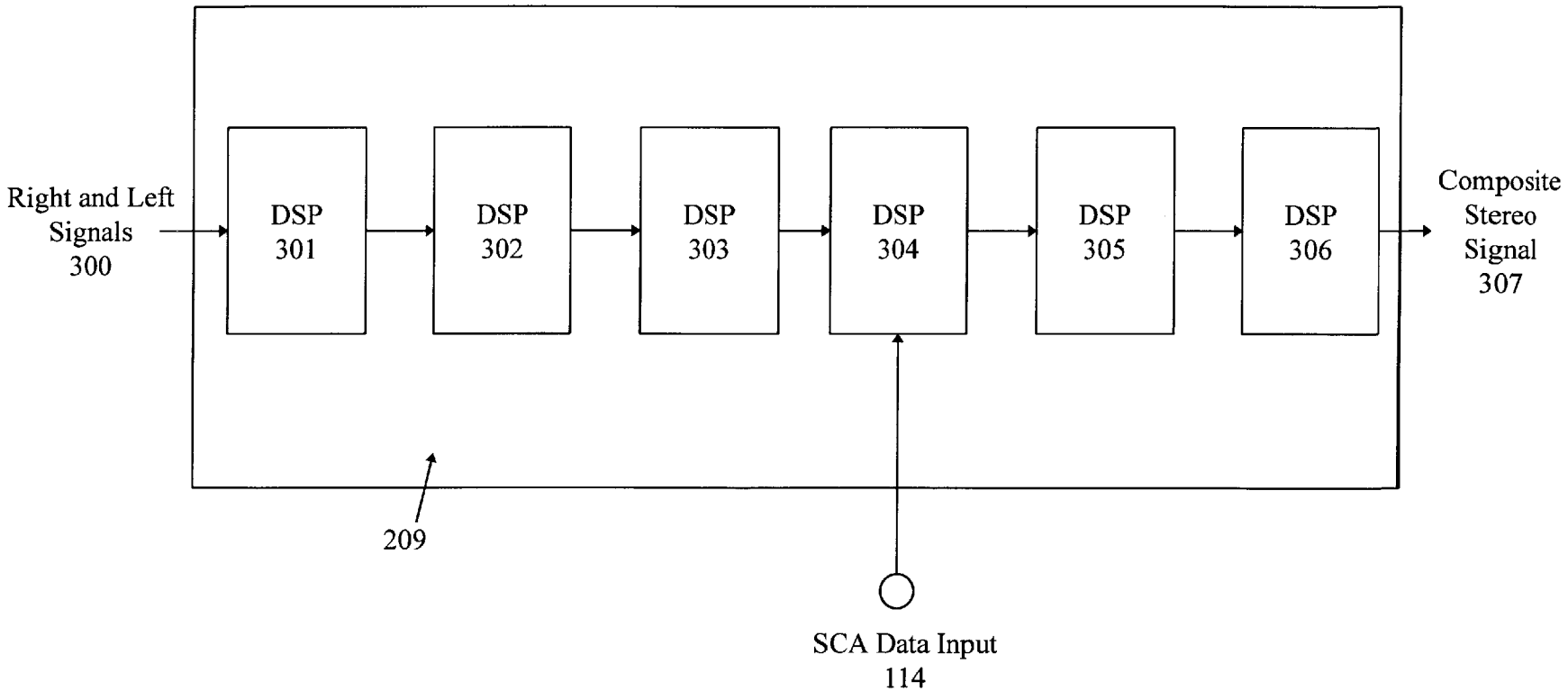
FIG. 3 illustrates the DSP of FIG. 2.

FIG. 2 shows a block diagram of an embodiment of the present invention. As before, left and right stereo signals 101 and 102 are provided through anti-aliasing filters 104 and 105 and A/D converters 107 and 108 to a DSP 209. The DSP 209 will be described in greater detail below with regard to FIG. 3. As shown in FIG. 3, DSP 209 includes six DSP units 301 to 306 each of which has a different sampling rate.

Figure 4:
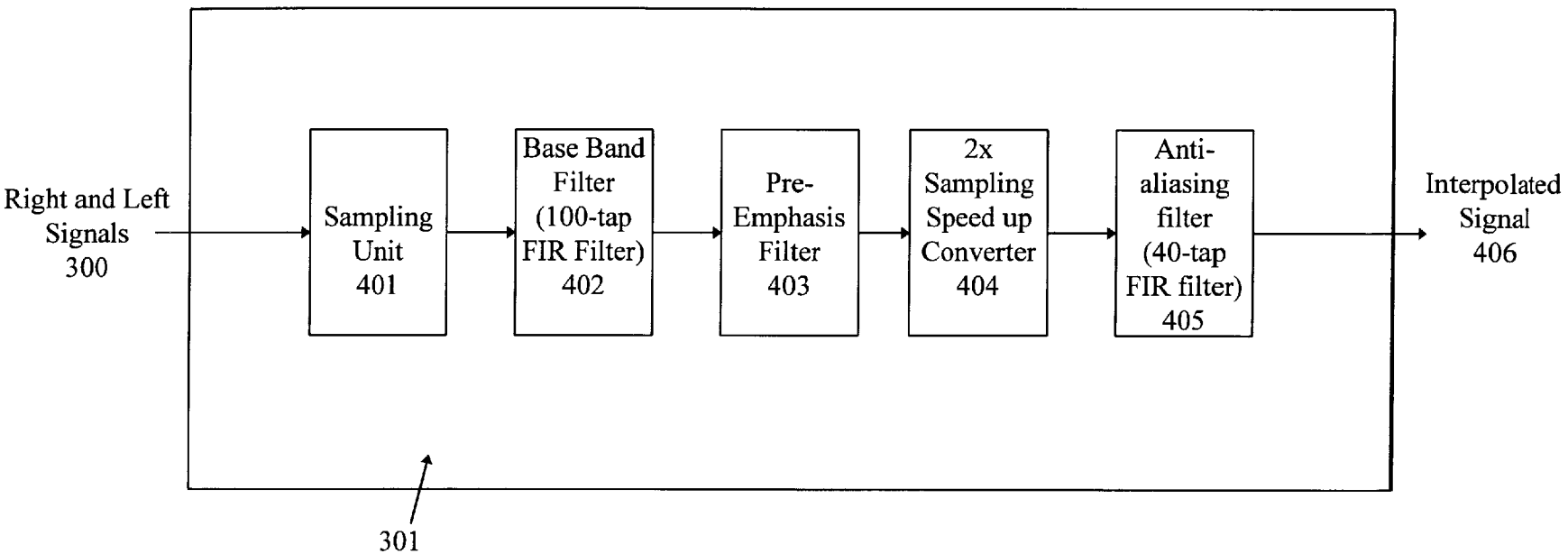
FIG. 4 illustrates the DSP 301 of FIG. 3.

DSP 301, which is shown in greater detail in FIG. 4, receives the right and left signals 300 from A/D converters 107 and 108. A sampling unit 401 samples the input signals. DSP 301 preferably samples the input signals at a frequency of 47.5 KHz×2.

DSP 301 then processes the sampled signals 300 by first performing base band filtering with filter 402 to eliminate cross talks between the modulated signals. The base band filter 402 is preferably a 100-tap FIR filter.

The output of filter 402 is then input to pre-emphasis filter 403 for pre-emphasis filtering. The filter shape is defined by the time constant, either 75 microseconds or 50 microseconds are preferably used.

Finally, DSP 301 performs two-time sampling speedup conversion with converter 404. This conversion adds one zero between the existing samples and doubles the sampling frequency to 95 KHz. However, the conversion also creates aliasing components in the image frequency. Accordingly, an anti-aliasing filter, preferably a 40-tap FIR low pass filter, 405 is used to remove the aliasing components. This low pass filter is constructed with a two-phase 20-tap filter to reduce the actual amount of computation. The result is an interpolated signal 406.

DSP modules 302 to 306 continue to interpolate the signal. The sampling rate of DSP 302 is preferably 95 KHz×2. The sampling rate of DSP 303 is preferably 190 KHz×2. The sampling rate of DSP 304 is preferably 380 KHz×3. The sampling rate of DSP 305 is preferably 1.14 MHz×4. The sampling rate of DSP 306 is preferably 4.56 MHz.

DSP 303 also computes the L+R and L−R signal and adds a 19 KHz pilot sub-carrier and the modulated L−R channel to form the composite stereo signal. The attenuation of the base band filter at 19 KHz is 120 dB. The sub-carrier frequency of the double side band suppressed carrier modulation is 38 KHz. Any base band frequency content above 19 KHz creates cross talk between the sum and difference channels.

If data is also to be broadcast on the Subsidiary Communication Authorization band (SCA), the SCA data 114 is input to DSP 304. DSP 304 can process and modulate the SCA data to a sub-carrier up to 99 KHz.

Figure 5:
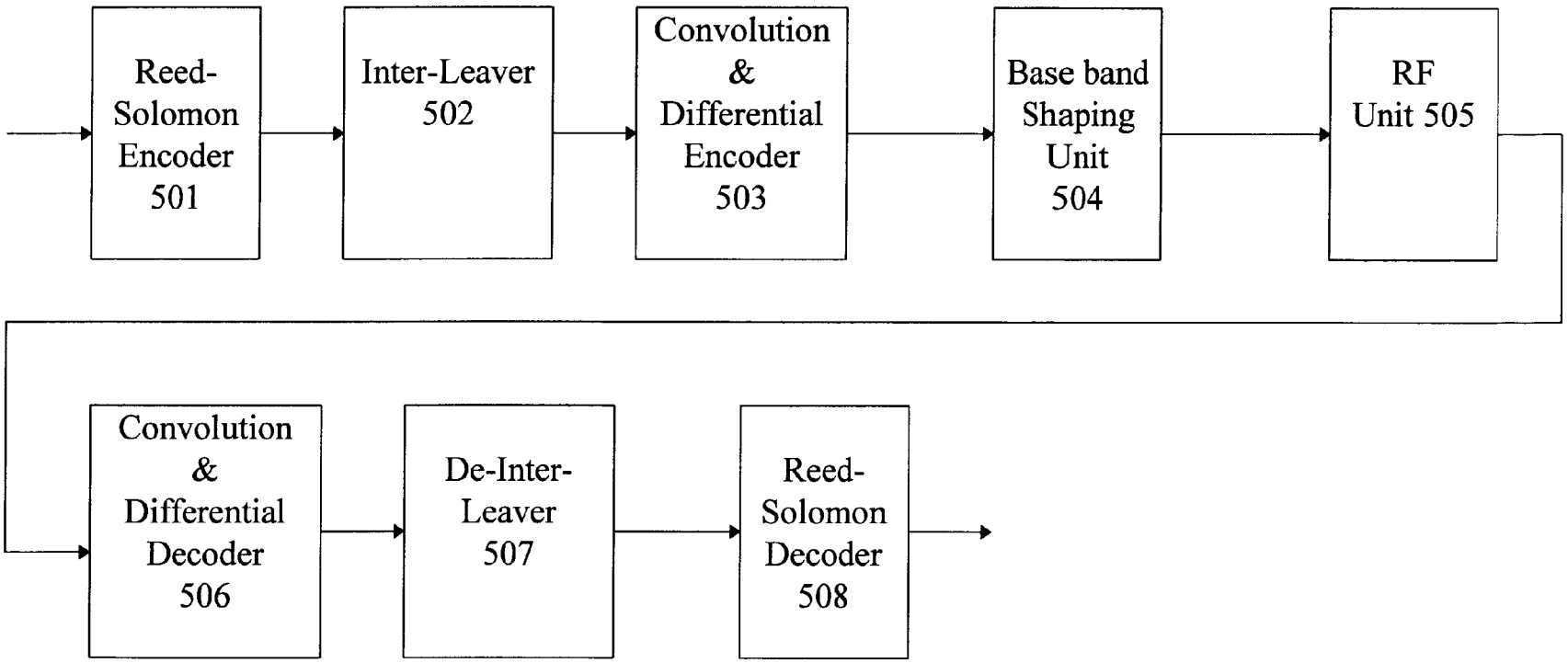
FIG. 5 illustrates an SCA error control circuit.

For high quality data broadcasting, an SCA error control circuit shown in FIG. 5 can be used. The error control circuit includes a Reed-Solomon encoder 501. The output of the encoder 501 is input to an inter-leaver 502. The signal from the inter-leaver 502 is passed through a convolution and differential encoder 503. The encoded signal is input to a base-band shaping unit 504 and then an RF unit 505. The signal is then decoded by a convolution and differential decoder 506, passed through a de-inter-leaver 507 and decoded by a Reed-Solomon decoder 508.

Returning to FIG. 2, the DSP 209 outputs a base band composite stereo signal 307. This signal in input to a Numerical Controlled Oscillator (NCO) 110 for direct digital FM modulation. The instantaneous frequency of the NCO 110 is modulated by the composite stereo base band signal 307. The frequency of the NCO 110 is instantaneously updated at a fraction of the NCO 110 clock speed. This method eliminates the need for expensive, high speed DSP processors and makes the direct digital stereo FM synthesizer practical.

It should be noted that limiting the frequency update rate to a fraction of the NCO 110 clock rate creates harmonic distortions. However, the harmonic content in the FM signal can be kept well below the main signal level if the sampling rate of the composite stereo signal is in the 1 MHz to 4 MHz range. Such low-level harmonic distortions can be removed by the an analog band pass filter 113.

In order to produce a 88 to 108 MHz RF signal, for example, for CATV broadcasting, the clock of the NCO 110 should have a frequency greater than 216 MHz. If the base band signal is updated at the same frequency, the additional up conversion would require extremely fast DSP chips which are very expensive and not practical. Such a high speed frequency update rate can be avoided by using different sampling rates for the NCO 110 and the composite stereo signal 307.

In the present invention, the sampling speed of the A/D converters 107 and 108 may be 47.5 KHz. After four times sampling speed up conversion, the clock rate is 10 times the sub-carrier 19 KHz. The generation of the pilot carrier is very convenient with this sampling speed. For high quality A/D conversion, a broadcast quality 64-time over-sampling 20-bit or 18-bit A/D converter can be used to achieve high dynamic range and high signal to noise ratio. One or two bits can also be allocated as head room for digital AGC control and soft clipping.

The modulated signal output by the NCO 110 is converted to an analog signal by D/A converter 111. The quantization noise from the D/A converter 111 will be limited by the band pass filter 113 and further reduced when the FM signal is eventually demodulated.

The signal to noise and distortion performance of the present invention is greatly enhanced by moving the D/A converter 111 from base band processing to the FM RF stage. For a typical FM system, a 38.8 dB signal to noise ratio improvement can be achieved. Thus for a 70 dB output signal to noise ratio, the required D/A output signal to noise ratio is 31.2 dB. In practice, RF D/A converters can achieve 60 dB signal to noise and distortion ratio at very reasonable cost. With an additional analog or digital tunable band pass filter (not shown) following the low pass filter 113 in FIG. 2, a very high signal to noise ratio can be achieved.

Figure 6:
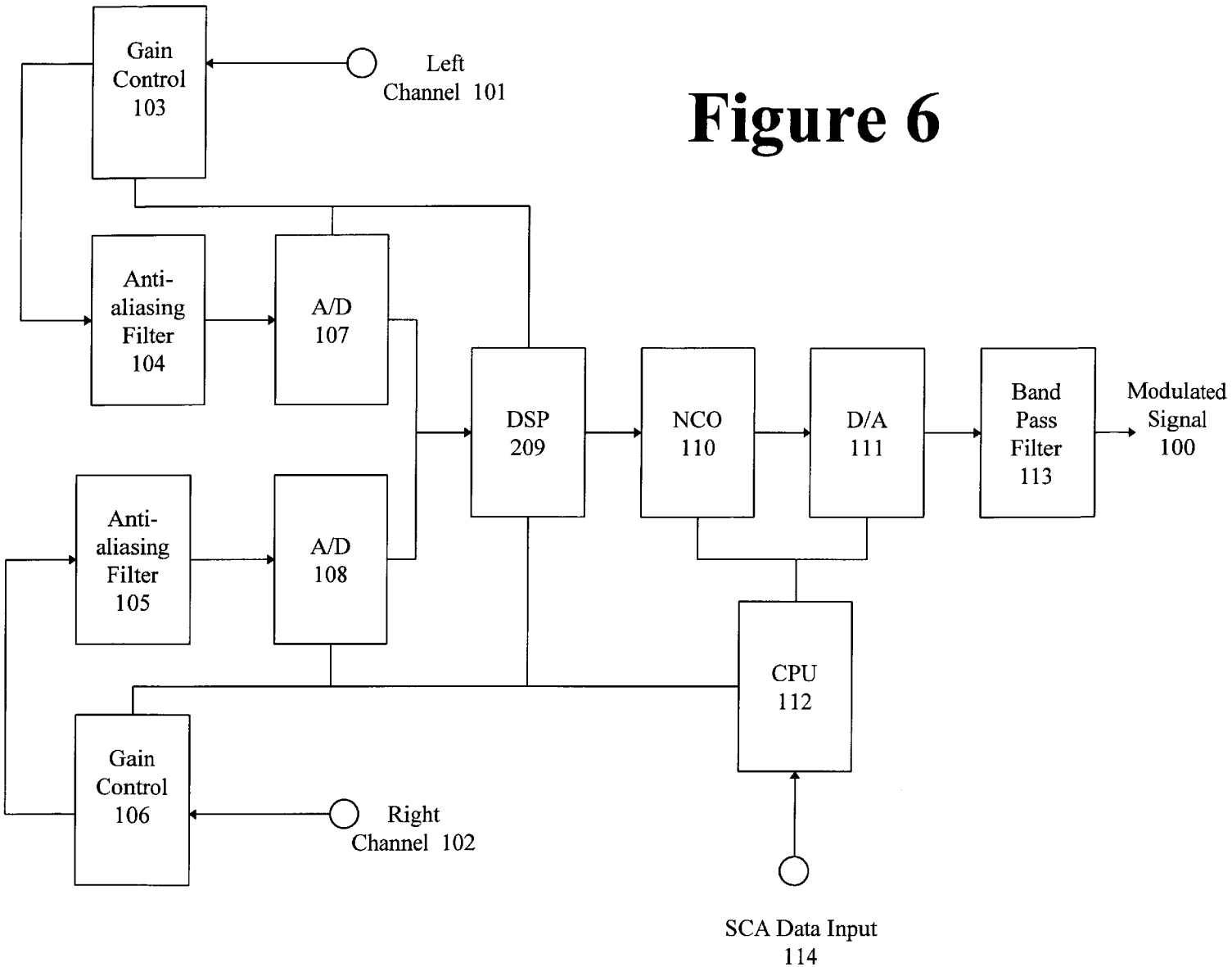
FIG. 6 illustrates a second system for producing a digital modulated signal according to the present invention.

FIG. 6 shows a second embodiment of the present invention. In FIG. 6, a CPU 112 is used to control the functioning of the NCO 110 and the D/A converter 111. The CPU 112 also receives the SCA data 114 and provides it to the DPS 209.

The embodiment of FIG. 6 also includes gain control units 103 and 106 respectively for the left and right signal channels 101 and 102. These gain control units control the A/D converters 107 and 108, and provide data to the DSP 209.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A digital modulated signal generator comprising:

a digital signal processor for receiving and processing left and right signal channels to produce a composite base band signal, wherein said digital signal processor comprises a first digital signal processing unit which receives and samples said left and right signals, said first digital processing unit having:

a base band filter to eliminate cross talk between said left and right signals;

a pre-emphasis filter receiving an output of said base band filter;

a sampling speed-up converter receiving an output of said pre-emphasis filter; and an anti-aliasing filter receiving an output of said sampling speed-up converter, said anti-aliasing filter outputting an interpolated signal; and a numerically controlled oscillator for receiving said composite base band signal and generating a modulated digitial carrier signal which is modulated in accordance with said composite base band signal.

2. A signal generator as claimed in claim 1, wherein said digital signal processor further comprises a second and a third digital signal processing unit, said second digital processing unit recieving said interpolated signal and providing an output signal to said third digital processing, said third digital processing unit computing addition (L+R) and difference (L−R) signals from said left and right signals.

3. A signal generator as claimed in claim 2, wherein said digital signal processor further comprises a fourth digital signal processing unit which receives SCA data and modulates a sub-carrier with said SCA data.

4. A signal generator as claimed in claim 3, further comprising an SCA error control circuit which governs said modulation of said sub-carrier, said SCA error control circuit comprising:

a Reed-Solomon encoder;

an inter-leaver connected to said Reed-Solomon encoder;

a convolution and differential encoder connected to said inter-leaver;

a base band shaping unit connected to said convolution and differential encoder;

a RF unit connected to said base band shaping unit;

a convolution and differential decoder connected to said RF unit;

a de-inter-leaver connected to said convolution and differential decoder; and a Reed-Solomon decoder connected to said de-inter-leaver.

5. A method of generating a modulated digital signal comprising the steps of:

digitally modulating a digitial carrier signal with a numerically controlled oscillator in accordance with a composite base band signal produced by a digital signal processor from left and right signals received from left and right signal channels;

controlling an SCA error with an SCA error control circuit having:

a Reed-Solomon encoder;

an inter-leaver connected to said Reed-Solomon encoder;

a convolution and differential encoder connected to said inter-leaver;

a base band shaping unit connected to said convolution and differential encoder;

an RF unit connected to said base band shaping unit;

a convolution and differential decoder connected to said RF unit;

a de-inter-leaver connected to said convolution and differential decoder; and a Reed-Solomon decoder connected to said de-inter-leaver; and modulating a sub-carrier with SCA data with said digital signal processor which receives an input signal containing said SCA data.

* * * * *

UNITED STATES PATENT AND TRADEMARK OFFICE

CERTIFICATE OF CORRECTION

PATENT NO. : 6,295,362 B1
DATED : September 25, 2001
INVENTOR(S) : Qin Zhang

It is certified that error appears in the above-identified patent and that said Letters Patent is hereby corrected as shown below:

Column 4,
Line 69, delete the word "the".

Column 5,
Line 39, replace "DPS" with -- DSP --.

Column 6,
Line 14, insert the word -- unit -- after "third digital processing".

Signed and Sealed this

Twenty-eighth Day of May, 2002

*Attest:*

*Attesting Officer*

JAMES E. ROGAN
*Director of the United States Patent and Trademark Office*